US008367591B2

(12) United States Patent
Kamano

(10) Patent No.: US 8,367,591 B2
(45) Date of Patent: Feb. 5, 2013

(54) LUBRICATING OIL COMPOSITION

(75) Inventor: Hideki Kamano, Chiba (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 0 days.

(21) Appl. No.: 12/447,168

(22) PCT Filed: Oct. 19, 2007

(86) PCT No.: PCT/JP2007/070435

§ 371 (c)(1),
(2), (4) Date: Apr. 24, 2009

(87) PCT Pub. No.: WO2008/050681

PCT Pub. Date: May 2, 2008

(65) Prior Publication Data

US 2010/0029520 A1 Feb. 4, 2010

(30) Foreign Application Priority Data

Oct. 27, 2006 (JP) ..... 2006-292738

(51) Int. Cl.
*C10M 141/00* (2006.01)
*C10M 141/12* (2006.01)

(52) U.S. Cl. ..... 508/280; 508/281; 508/364; 508/375; 508/501; 508/551; 508/555

(58) Field of Classification Search ..... 508/280, 508/281, 465, 501
See application file for complete search history.

(56) References Cited

U.S. PATENT DOCUMENTS

| | | | | |
|---|---|---|---|---|
| 3,330,763 | A | 7/1967 | Damrath, Jr. | |
| 4,701,273 | A | 10/1987 | Brady et al. | |
| 5,076,946 | A * | 12/1991 | Frankenfeld et al. | 508/281 |
| 5,356,547 | A * | 10/1994 | Arai et al. | 508/364 |
| 5,696,065 | A * | 12/1997 | Tanaka et al. | 508/465 |
| 6,410,490 | B1 | 6/2002 | Reyes-Gavilan et al. | |
| 2001/0044389 | A1 * | 11/2001 | Komiya et al. | 508/284 |
| 2005/0056241 | A1 * | 3/2005 | Nomura et al. | 123/90.6 |
| 2006/0019840 | A1 * | 1/2006 | Kawahara et al. | 508/485 |
| 2006/0090393 | A1 | 5/2006 | Rowland et al. | |

FOREIGN PATENT DOCUMENTS

| | | |
|---|---|---|
| EP | 1 338 641 A1 | 8/2003 |
| JP | 60 172973 | 9/1985 |
| JP | 5 186787 | 7/1993 |
| JP | 2005 220197 | 8/2005 |
| JP | 2005 220199 | 8/2005 |
| JP | 2006 182986 | 7/2006 |
| WO | WO 96/37581 | 11/1996 |

OTHER PUBLICATIONS

Russian Office Action dated Aug. 23, 2011 issued in the corresponding Russian Patent Application No. 2009120019/04(027591), filed May 26, 2009.

* cited by examiner

*Primary Examiner* — Ellen McAvoy
*Assistant Examiner* — Vishal Vasisth
(74) *Attorney, Agent, or Firm* — Oblon, Spivak, McClelland, Maier & Neustadt, L.L.P.

(57) ABSTRACT

Provided is a lubricating oil composition of an environmental regulation compliant type, comprising (A) a base oil for a lubricating oil, (B) sulfated oxymolybdenum dithiocarbamate, (C) an acid amide compound, (D) (d1) a fatty acid partial ester compound and/or (d2) an aliphatic amine compound and (E) a specific benzotriazole derivative, wherein a content of the component (B) is 0.02 to 0.1% by mass in terms of molybdenum; a content of the component (C) is 0.2 to 1.0 % by mass; a content of the component (D) is 0.2 to 1.0% by mass; and a content of the component (E) is 0.02 to 0.1% by mass each based on the whole amount of the composition, and it has an excellent friction reducing effect in combination with a high corrosion preventing effect to copper and lead.

24 Claims, No Drawings

LUBRICATING OIL COMPOSITION

BACKGROUND OF THE INVENTION

The present invention relates to a lubricating oil composition for internal combustion engines, more specifically to a lubricating oil composition for internal combustion engines which is improved in a corrosion inhibiting effect to metal materials and a friction reducing effect by using sulfated oxymolybdenum dithiocarbamate and a specific ashless base friction controlling agent in combination.

RELATED ART

At present, the environment is regulated more and more severely on a global scale, and particularly in situations surrounding automobiles, regulations to fuel consumption, exhaust gases and the like are becoming severer and severer. The above situations are backgrounded by environmental problems such as global warming and the like and resource protection originating in concerns about depletion of oil resources. It is estimated that saving of fuel consumption in automobiles shall be advanced more and more because of the reasons described above. In respect to saving of fuel consumption in automobiles, important is an improvement in engine oils such as a reduction in a viscosity of engine oils, addition of good friction controlling agents and the like for preventing a frictional loss in engines in addition to an improvement in automobiles themselves such as a reduction in a weight of cars, an improvement in engines and the like. However, a reduction in a viscosity of engine oils is a cause to bring about an increase in friction in the respective parts of an engine, and therefore a friction controlling agent, an extreme pressure agent and the like are more and more important in order to reduce a frictional loss caused by the above reduction in a viscosity and prevent wear.

On the other hand, iron base materials and aluminum base materials are principally used for sliding materials in engines and the like, but a large variety of aluminum, copper, tin, lead and the like without being limited to iron is used for materials of sliding parts, for example, bearing metals in main bearings, con'rod bearings and the like. The above copper- or lead-containing metal materials have the excellent characteristic that they have less fatigue phenomenon, but on the other hand, they have the defeat that they are liable to be corroded. Accordingly, a reduction in corrosion to various metal materials as well as a reduction in a frictional loss and prevention of wear each described above is required to lubricating oils and additives therefor.

As described above, various performances are required to lubricating oils, and therefore various additives are usually blended thereinto. However, even if additives are blended in the above complicated components for a purpose of obtaining some effects, the desired effects shall not necessarily be obtained. Even if the targeted effects are obtained, negative influences may be exerted on the other performances, and therefore it is important to investigate the combinations of the additives.

For example, sulfated oxymolybdenum dithiocarbamate (hereinafter abbreviated to MODTC) is excellent as a friction reducing agent in terms of a friction reducing effect, but on the other hand, sulfur-containing compounds such as MODTC have a corrosion property to copper, tin and the like, and therefore countermeasures therefor are required in many cases.

In respect to corrosion of metals, conditions of corrosion and easiness thereof are generally different according to the kind of metals, and therefore countermeasures are usually required to every metal. For example, benzotriazole derivatives are used as a metal inactivating agent, and corrosion to copper is inhibited by blending it, but an effect thereof is not exerted on other metals. Also, corrosion to lead is inhibited by adding zinc dithiophosphate (hereinafter abbreviated to ZnDTP), but since ZnDTP is also a sulfur-containing compound as is the case with ZnDTC, it has a corrosion property to copper, tin and the like.

In prevention of corrosion to metals, different methods from blending the corrosion inhibitors described above are proposed in recent years. It is disclosed in, for example, patent documents 1 and 2 that an effect of inhibiting corrosion to lead is derived by optimizing an ashless dispersant and that this allows prevention of corrosion to lead to be achieved even in the state that a content of zinc dithiophosphate is reduced.

Lubricating oil compositions described in the documents described above are improved in an effect of preventing corrosion to lead, but corrosion to copper brought about by using sulfur-containing compounds is not prevented. Accordingly, corrosion to copper brought about by blending MoDTC can not be prevented by a technique of optimizing ashless dispersants, and use of MODTC having an excellent friction reducing ability remains limited as ever.

Patent document 1: Japanese Patent Application Laid-Open No.

Patent document 2: Japanese Patent Application Laid-Open No.

DISCLOSURE OF THE INVENTION

The present invention has been made under the situation described above, and an object of the present invention is to provide a lubricating oil composition of an environmental regulation compliant type which is provided with an excellent friction reducing effect and a high corrosion preventing effect to copper and lead in combination by combining MODTC and an ashless friction controlling agent with a metal inactivating agent.

Intensive researches repeated by the present inventors in order to achieve the object described above have resulted in finding that a high corrosion preventing effect to copper is obtained by combining MODTC with a specific amount of an acid amide compound and a metal inactivating agent. The corrosion property to lead is enhanced by blending the above acid amide compound, but it has been found that the above undesirable influence is inhibited by blending a fatty acid partial ester compound or an aliphatic amine compound. The present invention has been completed based on the above knowledge.

That is, the present invention provides a lubricating oil composition for internal combustion engines comprising (A) a base oil for a lubricating oil, (B) sulfated oxymolybdenum dithiocarbamate represented by Formula (I):

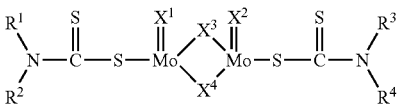

(I)

[Ka 1]

(in Formula (I), $R^1$ to $R^4$ each represent independently a hydrocarbyl group having 4 to 22 carbon atoms, and $X^1$ to $X^4$ each represent a sulfur atom or an oxygen atom), (C) an acid amide compound, (D) (d1) a fatty acid partial ester compound and/or (d2) an aliphatic amine compound and (E) a benzotriazole derivative represented by Formula (II):

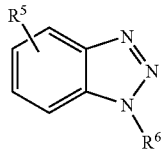

(II)

[Ka 2]

(in Formula (II), $R^5$ and $R^6$ each are independently a hydrocarbyl group having 1 to 30 carbon atoms which may contain an oxygen atom, a sulfur atom or a nitrogen atom), wherein a content of the component (B) is 0.02 to 0.1% by mass in terms of molybdenum; a content of the component (C) is to 1.0% by mass; a content of the component (D) is 0.2 to % by mass; and a content of the component (E) is 0.02 to % by mass each based on a whole amount of the composition.

According to the present invention, a lubricating oil composition of an environmental regulation compliant type for internal combustion engines which is provided with an excellent friction reducing effect and a high corrosion preventing effect to copper and lead in combination, to be specific, a lubricating oil composition which is used for internal combustion engines such as gasoline engines, diesel engines, gas engines and the like can be provided by using (A) the base oil for a lubricating oil, (B) the sulfated oxymolybdenum dithiocarbamate, (C) the acid amide compound, (D) the fatty acid partial ester compound and/or the aliphatic amine compound and (E) the specific benzotriazole derivative in combination.

BEST MODE FOR CARRYING OUT THE INVENTION

The lubricating oil composition of the present invention is obtained by blending (A) the base oil for a lubricating oil, a specific amount of (B) the sulfated oxymolybdenum dithiocarbamate, a specific amount of (C) the acid amide compound, a specific amount of (D) (d1) the fatty acid partial ester compound and/or (d2) the aliphatic amine compound and a specific amount of (E) the specific benzotriazole derivative, and it is characterized by using the above components (A) to (E) in combination.

The base oil (A) for a lubricating oil in the lubricating oil composition of the present invention shall not specifically be restricted, and optional oils suitably selected from mineral oils and synthetic oils which have so far been used as base oils of lubricating oils for internal combustion engines can be used.

The mineral oils include, for example, mineral oils prepared by distilling a crude oil at an atmospheric pressure to obtain an atmospheric residual oil, distilling the residual oil under reduced pressure to obtain a lubricating oil fraction and refining the above fraction by subjecting to at least one of treatments such as debitumen by a solvent, extraction by a solvent, hydrocracking, dewaxing by a solvent, catalytic dewaxing, hydrorefining and the like and mineral oils produced by isomerizing waxes and GTL WAX.

On the other hand, the synthetic oils include, for example, polybutene, polyolefins (α-olefin homopolymers and copolymers (for example, ethylene-α-olefin copolymers) and the like), various esters (for example, polyol esters, dibasic acid esters, phosphoric esters and the like), various ethers (for example, polyphenyl ether and the like), polyglycols, alkylbenzene, alkylnaphthalene and the like. Among the above synthetic oils, polyolefins and polyol esters are particularly preferred.

In the present invention, the mineral oils described above may be used alone or in combination of two or more kinds thereof as the base oil. Also, the synthetic oils described above may be used alone or in combination of two or more kinds thereof as the base oil. Further, at least one mineral oil and at least synthetic oil may be used in combination.

A viscosity of the base oil shall not specifically be restricted and is varied according to the uses of the lubricating oil composition, and a kinematic viscosity thereof at 100° C. is usually 2 to 30 $mm^2/s$, preferably 3 to 15 $mm^2/s$ and particularly preferably 4 to 10 $mm^2/s$. If the kinematic viscosity at 100° C. is 2 $mm^2/s$ or more, the vaporization loss is small, and if it is 30 $mm^2/s$ or less, the power loss brought about by the viscosity resistance is inhibited, so that the fuel consumption improving effect is obtained.

Oils in which % $C_A$ measured by ring analysis is 3.0 or less and in which a content of sulfur is 50 ppm by mass or less are preferably used as the base oil. In this case, the % $C_A$ measured by ring analysis shows a proportion (percentage) of aromatics calculated by a ring analysis n-d-M method. The sulfur content is a value measured according to JIS K 2541.

The base oil in which % $C_A$ is 3.0 or less and in which a content of sulfur is 50 ppm by mass or less has a good oxidation stability and can inhibit a rise in the acid value and production of sludges, and it can provide a lubricating oil composition having less corrosion property to metals.

The % $C_A$ is more preferably 1.0 or less, further preferably 0.5 or less, and the sulfur content is more preferably 30 ppm by mass or less.

Further, a viscosity index of the base oil is preferably 70 or more, more preferably 100 or more and further preferably 120 or more. The base oil having a viscosity index of 70 or more has less change of a viscosity caused by a change of temperature.

A compound represented by the following Formula (I) is used as the sulfated oxymolybdenum dithiocarbamate (B) of the present invention:

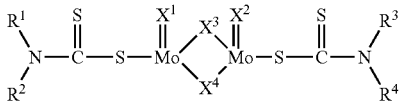

(I)

[Ka 3]

In Formula (I), $R^1$ to $R^4$ are a hydrocarbyl group having 4 to 22 carbon atoms, and they are, for example, an alkyl group, an alkenyl group, an alkylaryl group, a cycloalkyl group, a cycloalkenyl group and the like. Among them, $R^1$ to $R^4$ are preferably a branched or linear alkyl group or alkenyl group having 4 to 18 carbon atoms, more preferably an alkyl group having 8 to 13 carbon atoms. They include, for example, n-octyl, 2-ethylhexyl, isononyl, n-decyl, isodecyl, dodecyl, tridecyl, isotridecyl and the like. If the carbon number is too small, the composition is poor in an oil solubility, and if the carbon number is too large, the composition is elevated in a melting point, deteriorated in handling and reduced in an activity. $R^1$ to $R^4$ may be the same as or different from each other, and if $R^1$ and $R^2$ and $R^3$ and $R^4$ are different alkyl groups, the solubility in the base oil, the storage stability and a persistency of the friction reducing ability are enhanced.

In Formula (I), $X^1$ to $X^4$ each are a sulfur atom or an oxygen atom, and all of $X^1$ to $X^4$ may be a sulfur atom or an oxygen atom or four of $X^1$ to $X^4$ each may be a sulfur atom or an oxygen atom. A ratio of a sulfur atom to an oxygen atom is preferably 1/3 to 3/1, more preferably 1.5/2.5 to 3/1 in terms of sulfur atom/oxygen atom from the viewpoints of the corrosion resistance and enhancing the solubility in the base oil.

In the present invention, the above component (B) may be used alone or in combination of two or more kinds thereof. A content of the component (B) in the lubricating oil composition is selected so that a content of molybdenum in the component (B) is 0.02 to 0.1% by mass, preferably 0.03 to 0.08% by mass. If it is less than 0.02% by mass, the satisfactory friction reducing effect is not obtained, and if it is more than 0.1% by mass, the corrosion property to copper is enhanced.

Acid amide compounds which have so far been used as friction controlling agents for lubricating oil compositions can be used as the acid amide compound (C) in the present invention. In the present invention, the acid amide compound (C) is provided with an effect of reducing friction as well as an effect of reducing corrosion to copper materials by using in combination with MODTC (B).

The acid amide compound (C) is a compound obtained by using mono- to tetravalent carboxylic acids and alkylamine or alkanolamine.

The monovalent carboxylic acid described above is preferably carboxylic acid containing a hydrocarbon group having 6 to 30 carbon atoms, particularly preferably carboxylic acid having a linear or branched, saturated or unsaturated hydrocarbon group. The hydrocarbon group constituting the above monovalent carboxylic acid includes alkyl groups such as hexyl, heptyl, octyl, nonyl, decyl, undecyl, dodecyl, tridecyl, tetradecyl, pentadecyl, hexadecyl, heptadecyl, octadecyl, nonadecyl, icosyl, pentaicosyl, docosyl, tricosyl, tetracosyl, pentacosyl, hexacosyl, heptacosyl, octacosyl, nonacosyl, triacontyl and the like, alkenyl groups such as hexenyl, heptenyl, octenyl, nonenyl, decenyl, undecenyl, dodecenyl, tridecenyl, tetradecenyl, pentadecenyl, hexadecenyl, heptadecenyl, octadecenyl, nonadecenyl, icosenyl, henicosenyl, docosenyl, tricosenyl, tetracosenyl, pentacosenyl, hexacosenyl, heptacosenyl, octacosenyl, nonacosenyl, triacontenyl and the like, hydrocarbon groups having two or more double bonds and the like. Di- to tetravalent polycarboxylic acids include oxalic acid, phthalic acid, trimellitic acid, pyromellitic acid and the like.

On the other hand, the alkylamine compound described above is preferably an alkylamine compound having a linear or branched hydrocarbon group having 6 to 30 carbon atoms, and the above hydrocarbon group includes the groups shown as the examples of the hydrocarbon groups in the carboxylic acids described above.

Further, the alkanolamine compound described above is preferably an alkanolamine compound having a hydroxyalkyl group having 2 to 6 carbon atoms.

From the viewpoints of the friction reducing effect and the corrosion preventing effect to copper, the acid amide compound (C) is preferably an acid amide compound obtained by reacting alkanolamine having a hydroxyalkyl group having 2 to 6 carbon atoms with monovalent fatty acid having a linear or branched hydrocarbon group having 6 to 30 carbon atoms. The hydrocarbon group of the monovalent fatty acid has more preferably 8 to 24 carbon atoms, particularly preferably 10 to 20 carbon atoms.

The alkanolamine includes monoethanolamine, diethanolamine, triethanolamine, N-methylethanolamine, N,N-dimethylethanolamine, N-ethylethanolamine, N,N-diethylethanolamine, N-isoprpylethanolamine, N,N-diisopropylethanolamine, monoisopropanolamine, diisopropanolamine, triisopropanolamine, N-methylisopropanolamine, N,N-dimethylisopropanolamine, N-ethylisopropanolamine, N,N-diethylisopropanolamine, N-isoprpylisopropanolamine, N,N-diisopropylisopropanolamine, mono-n-propanolamine, di-n-propanolamine, tri-n-propanolamine, N-methyl-n-propanolamine, N,N-dimethyl-n-propanolamine, N-ethyl-n-propanolamine, N,N-diethyl-n-propanolamine, N-isopropyl-n-propanolamine, N,N-diisopropyl-n-propanolamine, monobutanolamine, dibutanolamine, tributanolamine, N-methylbutanolamine, N,N-dimethylbutanolamine, N-ethylbutanolamine, N,N-diethylbutanolamine, N-isopropylbutanolamine, N,N-diisopropylbutanolamine and the like.

The monovalent fatty acid having a linear or branched hydrocarbon group having 6 to 30 carbon atoms includes saturated fatty acids such as caproic acid, caprylic acid, capric acid, lauric acid, myristic acid, palmitic acid, stearic acid, arachidic acid, behenic acid, lignoceric acid and the like and unsaturated fatty acids such as myristoleic acid, palmitoleic acid, oleic acid, linilenic acid and the like, and the unsaturated fatty acids are preferred in terms of the friction reducing effect.

The preferred examples of the acid amide compound obtained by reacting the alkanolamine described above with the monovalent fatty acid having a linear or branched hydrocarbon group having 6 to 30 carbon atoms include oleic acid monoethanolamide, oleic acid diethanolamide, oleic acid monopropanolamide, oleic acid dipropanolamide and the like.

In the present invention, the acid amide (C) may be used alone or in combination of two or more kinds thereof. A blending amount thereof is 0.2 to 1.0% by mass, preferably 0.25 to 0.8% by mass and more preferably 0.3 to 0.6% by mass based on a whole amount of the composition. If it is less than 0.2% by mass, the satisfactory effects are not obtained in both of the friction reducing effect and the copper corrosion preventing effect, and if it is more than 1.0% by mass, not only the effect meeting it is not obtained, but also corrosion to lead results in being markedly shown.

Compounds which have so far been used as friction controlling agents for lubricating oil compositions can be used as (D) (d1) the fatty acid partial ester compound and/or (d2) the aliphatic amine compound in the present invention. In the present invention, the component (D) is provided with an effect of reducing corrosion to lead materials by using it in combination with MODTC (B) and the acid amide (C).

The fatty acid partial ester compound (d1) in the present invention is a partial ester compound obtained by reacting fatty acid with aliphatic polyhydric alcohol.

The fatty acid described above is preferably fatty acid having a linear or branched hydrocarbon group having 6 to 30 carbon atoms, and the above hydrocarbon group has more preferably 8 to 24 carbon atoms, particularly preferably 10 to 20 carbon atoms.

The linear or branched hydrocarbon group having 6 to 30 carbon atoms includes the groups shown as the examples of the substituents of the acid amide (C), and the fatty acid includes saturated fatty acids such as caproic acid, caprylic acid, capric acid, lauric acid, myristic acid, palmitic acid, stearic acid, arachidic acid, behenic acid, lignoceric acid and the like and unsaturated fatty acids such as myristoleic acid, palmitoleic acid, oleic acid, linilenic acid and the like, and the unsaturated fatty acids are preferred in terms of the friction reducing effect.

The aliphatic polyhydric alcohol described above is di- to hexahydric alcohols and includes ethylene glycol, glycerin, trimethylolpropane, pentaerythritol, sorbitol and the like, and glycerin is preferred in terms of the friction reducing effect.

The fatty acid partial ester compound obtained by reacting glycerin with the unsaturated fatty acid described above includes monoesters such as glycerol monomyristate, glycerol monopalmitate, glycerol monooleate and the like and diesters such as glycerol dimyristate, glycerol dipalmitate, glycerol dioleate and the like, and the monoesters are preferred. The partial ester compound includes as well reaction products with silicon compounds or boron compounds, and the reaction products with the boron compounds are preferred.

The aliphatic amine compound (d2) in the present invention is an amine compound having a linear or branched hydrocarbon group having preferably 6 to 30 carbon atoms, more preferably 8 to 24 carbon atoms and particularly preferably 10 to 20 carbon atoms. The linear or branched hydrocarbon group having 6 to 30 carbon atoms includes the groups shown as the examples of the substituents of the acid amide (C). Aliphatic monoamines or alkylene oxide adducts thereof, alkanolamines, aliphatic polyamines, imidazoline compounds and the like can be shown as the examples of the aliphatic amine compound (d2) described above. To be specific, it includes aliphatic amine compounds such as laurylamine, lauryldiethylamine, lauryldiethanolamine, dodecyldipropanolamine, palmitylamine, stearylamine, stearyltetraethylenepentamine, oleylamine, oleylpropylenediamine, oleyldiethanolamine, N-hydroxyethyloleylimidazoline and the like and amine alkylene oxide adducts of the above aliphatic amine compounds, such as N-dipolyoxyalkylene-N-alkyl (or alkenyl) (6 to 28 carbon atoms).

In the present invention, the compound (d1) and the compound (d2) described above may be used alone or in combination as the component (D). Further, plural compounds (d1) and/or plural compounds (d2) may be used. A blending amount of the component (D) is 0.2 to 1.0% by mass, preferably 0.25 to 0.8% by mass and more preferably 0.3 to % by mass in terms of the total of both components from the viewpoint of the lead corrosion preventing effect and the friction reducing effect. If it is less than 0.2% by mass, the satisfactory effects are not obtained in both of the lead corrosion preventing effect and the friction reducing effect, and if it is more than 1.0% by mass, the effect meeting it is not obtained.

In the present invention, (E) a benzotriazole derivative represented by Formula (II) is blended as a metal inactivating agent. Blending thereof makes it possible to enhance more the corrosion preventing effect to copper.

(II)

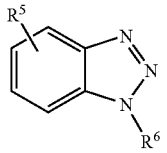

[Ka 4]

In Formula (II), $R^5$ and $R^6$ each are independently a hydrocarbyl group having 1 to 30 carbon atoms, preferably 1 to carbon atoms, more preferably 2 to 18 carbon atoms and particularly preferably 3 to 18 carbon atoms. The above hydrocarbyl group may be any of linear, branched and cyclic groups and may contain an oxygen atom, a sulfur atom or a nitrogen atom. $R^5$ and $R^6$ may be the same as or different from each other.

The benzotriazole derivative (E) described above is added in an amount of 0.02 to 0.1% by mass, preferably 0.03 to 0.05% by mass in terms of an effect thereof. The benzotriazole derivative (E) may be used alone or in combination of two or more kinds thereof. Further, it may be used in combination with other metal inactivating agents.

In the present invention, (F) zinc dithiophosphate may be blended, and blending thereof makes it possible to enhance more the corrosion preventing effect to lead as a well as the wear resistance. Zinc dithiophosphate includes a compound represented by Formula (III):

(III)

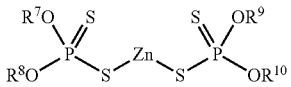

[Ka 5]

In Formula (III), $R^7$, $R^8$, $R^9$ and $R^{10}$ each represent a substituent selected from a primary or secondary alkyl group having 3 to 22 carbon atoms or an alkylaryl group substituted with an alkyl group having 3 to 18 carbon atoms, and they may be the same as or different from each other.

In the present invention, the above zinc dithiophosphate may be used alone or in combination of two or more kinds thereof. In particular, the composition comprising zinc dithiophosphate having a secondary alkyl group as a principal component is preferred since it enhances the wear resistance.

The specific examples of zinc dithiophosphate include zinc dipropyldithiophosphate, zinc dibutyldithiophosphate, zinc dipentyldithiophosphate, zinc dihexyldithiophosphate, zinc diisopentyldithiophosphate, zinc diethylhexyldithiophosphate, zinc dioctyldithiophosphate, zinc dinonyldithiophosphate, zinc didecyldithiophosphate, zinc didodecyldithiophosphate, zinc dipropylphenyldithiophosphate, zinc dipentylphenyldithiophosphate, zinc dipropylmethylphenyldithiophosphate, zinc dinonylphenyldithiophosphate, zinc didodecylphenyldithiophosphate and the like.

In the lubricating oil composition of the present invention, the zinc dithiophosphate (F) is blended so that a content thereof is preferably 0.02 to 0.10% by mass, more preferably 0.03 to 0.08% by mass in terms of phosphorus based on the whole amount of the composition. If the above phosphorus content is less than 0.02% by mass, the wear resistance and the high temperature cleaning property are not satisfactory, and if it exceeds 0.10% by mass, catalyst poisoning of the exhaust gas catalyst is notably exhibited. Accordingly, both are not preferred.

Other additives, for example, a viscosity index improving agent, a pour point depressant, a cleaning dispersant, an antioxidant, a wear resistant agent or an extreme pressure agent, a friction reducing agent, a dispersant, a rust preventive, a surfactant or an emulsification resistant agent, a defoaming agent and the like can be blended, if necessary, with the lubricating oil composition of the present invention as long as the object of the present invention is not damaged.

The viscosity index improving agent includes, for example, polymethacrylates, dispersion type polymethacrylates, olefin base copolymers (for example, ethylene-propylene copolymers and the like), dispersion type olefin base copolymers, styrene base copolymers (for example, styrene-diene copolymers, styrene-isoprene copolymers and the like) and the like.

A blending amount of the above viscosity index improving agents is usually 0.5 to 15% by mass, preferably 1 to 10% by mass based on a whole amount of the lubricating oil composition in terms of a blending effect.

The pour point depressant includes, for example, polymethacrylates having a weight average molecular weight of 5,000 to 50,000 and the like.

An ashless dispersant and/or a metal base detergent can be used as the detergent dispersant. Optional ashless dispersants used for lubricating oils can be used as the ashless dispersant and include a succinimide compound of a mono type represented by Formula (IV) or a succinimide compound of a bis type represented by Formula (V):

[Ka 6]

(IV)

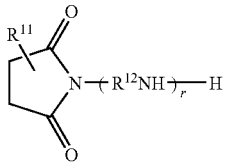

(V)

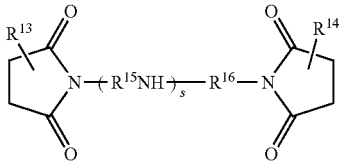

In Formulas (IV) and (V), $R^{11}$, $R^{13}$ and $R^{14}$ are an alkenyl group or an alkyl group each having a number average molecular weight of 500 to 3,000, and $R^{13}$ and $R^{14}$ may be the same or different; $R^{11}$, $R^{13}$ and $R^{14}$ have a number average molecular weight of preferably 1,000 to 3,000; $R^{12}$, $R^{15}$ and $R^{16}$ each are an alkylene group having 2 to 5 carbon atoms, and $R^{15}$ and $R^{16}$ may be the same or different; r represents an integer of 1 to 10; and s represents 0 or an integer of 1 to 10.

If a number average molecular weight of $R^{11}$, $R^{13}$ and $R^{14}$ described above is less than 500, the solubility in the base oil is reduced. If it exceeds 3,000, the cleaning property is reduced, and no targeted performances are likely to be obtained. Also, the term r described above is preferably 2 to 5, more preferably 3 to 4. If the term r is less than 1, the cleaning property is deteriorated, and if r is 11 or more, the solubility in the base oil is deteriorated.

In Formula (V), the term s is preferably 1 to 4, more preferably 2 to 3. If s falls in the range described above, it is preferred in terms of the cleaning property and the solubility in the base oil. A polybutenyl group, a polyisobutenyl group and an ethylene-propylene copolymer can be listed as the alkenyl group, and the alkyl group is obtained by hydrogenating the above groups.

The representative example of the suited alkenyl group includes a polybutenyl group or a polyisobutenyl group. The polybutenyl group is obtained by polymerizing 1-butene with a mixture of isobutenes or isobutene of a high purity. The representative example of the suited alkyl group includes a group obtained by hydrogenating the polybutenyl group or the polyisobutenyl group.

The alkenyl- or alkylsuccinimide compound described above can be produced usually by reacting polyamine with alkenylsuccinic anhydride obtained by reacting polyolefin with maleic anhydride or alkylsuccinic anhydride obtained by hydrogenating it.

The succinimide compound of a mono type and the succinimide compound of a bis type each described above can be produced by changing a reaction proportion of alkenylsuccinic anhydride or alkylsuccinic anhydride to polyamine.

α-Olefin having 2 to 8 carbon atoms can be used alone or in a mixture of two or more kinds thereof as an olefin monomer forming the polyolefin described above, and a mixture of isobutene and 1-butene can suitably be used.

On the other hand, the polyamine includes single diamines such as ethylenediamine, propylenediamine, butylenediamine, pentylenediamine and the like, polyalkylenepolyamines such as diethylenetriamine, triethylenetetramine, tetraethylenepentamine, pentaethylenehexamine, di(methylethylene)triamine, dibutylenetriamine, tributylenetetramine, pentapentylenehexamine and the like and piperazine derivatives such as aminoethylpiperazine and the like.

In addition to the alkenyl- or alkylsuccinimide compound described above, a boron derivative thereof and/or compounds obtained by modifying them with organic acids may be used as well. The boron derivative of the alkenyl- or alkylsuccinimide compound, which is produced by a conventional method, can be used.

For example, the polyolefin described above is reacted with maleic anhydride to obtain alkenylsuccinic anhydride, and it is further reacted with an intermediate obtained by reacting the polyamine described above with a boron compound such as boron oxide, halogenated boron, boric acid, boric anhydride, boric ester, ammonium borate and the like and subjected to imidation, whereby the boron derivative is obtained.

A boron content in the boron derivative shall not specifically be restricted, and it is usually 0.05 to 5% by mass, preferably 0.1 to 3% by mass in terms of boron.

A content of the above succinimide compounds is 0.5 to 15% by mass, preferably 1 to 10% by mass base on a whole amount of the lubricating oil composition. If it is less than 0.5% by mass, the effect thereof is less liable to be exhibited, and if it is more than 15% by mass, the effect meeting the addition thereof is not obtained. Further, the succinimide compound has a corrosion property to lead, and therefore it is not preferred to add an amount more than necessary. The succinimide compound has to be suitably selected in order to achieve an oxidation stability and prevention of metal corrosion in the lubricating oil at the same time. From the above point of view, the preferred succinimide compound is a polybutenylsuccinimide compound of a bis type containing a polybutenyl group having a number average molecular weight of 1500 or more, and the corrosion property to lead can be inhibited by blending it in a proportion of preferably 60% or more, more preferably 70% or more based on a whole nitrogen amount of the succinimide compound. The succinimide compound may be used alone or in combination of two or more kinds thereof as long as the prescribed amount described above is added.

Optional alkaline earth metal base detergents used for lubricating oils can be used as the metal base detergent, and they include, for example, alkaline earth metal sulfonates, alkaline earth metal phenates, alkaline earth metal salycilates and mixtures of two or more compounds selected from the above compounds. The alkaline earth metal sulfonates include alkaline earth metal salts of alkylated aromatic sulfonic acids obtained by sulfonating alkylated aromatic compounds having a molecular weight of 300 to 1,500, preferably 400 to 700, particularly magnesium salts and/or calcium salts thereof, and among them, the calcium salts are preferably used. The alkaline earth metal phenates include alkaline earth metal salts of alkylphenols, alkylphenol sulfides and Mannich reaction products of alkylphenols, particularly magnesium salts and/or calcium salts thereof, and among them, the calcium salts are preferably used. The alkaline earth metal salycilates include alkaline earth metal salts of alkylsalycilic acids, particularly magnesium salts and/or calcium salts thereof, and among them, the calcium salts are preferably used. The alkyl group constituting the alkaline earth metal base detergents described above is preferably an alkyl group having 4 to 30 carbon atoms, more preferably a linear or branched alkyl group having 6 to 18 carbon atoms, and it may be either linear or branched. It may be a primary alkyl group, a secondary alkyl group or a tertiary alkyl group. The alkaline earth metal sulfonates, the alkaline earth metal phenates and the alkaline earth metal salycilates include neutral alkaline earth metal sulfonates, neutral alkaline earth metal phenates and neutral alkaline earth metal salycilates which are obtained by reacting the alkylated aromatic sulfonic acids, the alkylphenols, the alkylphenol sulfides, the Mannich reaction products of alkylphenols and the alkylsalycilic acids each described above directly with alkaline earth metal bases such as oxides and hydroxides of alkaline earth metals of magnesium and/or calcium, or once preparing alkaline metal salts such as sodium salts, potassium salts and the like and then substituting them with alkaline earth metal salts, and in addition thereto, they include as well basic alkaline earth metal sulfonates, basic alkaline earth metal phenates and basic alkaline earth metal salycilates which are obtained by heating neutral alkaline earth metal sulfonates, neutral alkaline earth metal phenates and neutral alkaline earth metal salycilates with excessive alkaline earth metal salts and alkaline earth metal bases under the presence of water and perbasic alkaline earth metal sulfonates, perbasic alkaline earth metal phenates and perbasic alkaline earth metal salycilates which are obtained by reacting neutral alkaline earth metal sulfonates, neutral alkaline earth metal phenates and neutral alkaline earth metal salycilates with carbonates or borates of alkaline earth metals under the presence of carbon dioxide.

In the present invention, the neutral salts, the basic salts, the perbasic salts each described above and the mixtures thereof can be used as the metal base detergent, and particularly the mixtures of at least one of the perbasic salycilates, the perbasic phenates and the perbasic sulfonates with the neutral sulfonates are preferred in terms of a cleanliness and a wear resistance of an inside in an engine.

The metal base detergent is put on sale and can be obtained usually in the state that it is diluted with a light base oil for a lubricating oil. In general, the metal base detergent having a metal content of 1.0 to 20% by mass, preferably 2.0 to 16% by mass is preferably used.

In the present invention, a whole base number of the metal base detergent is usually 10 to 500 mg KOH/g, preferably 15 to 450 mg KOH/g, and at least one or two or more selected therefrom can be used in combination. The whole base number referred to herein means a whole base number measured by a potentiometric titration method according to 7. Of JIS K 2501 "Petroleum products and lubricating oils-neutralization value test method".

The metal base detergent of the present invention shall not specifically be restricted in a metal ratio, and a single kind or a mixture of two or more kinds of the metal base detergent having a metal ratio of usually 20 or less can be used. The metal base detergent having a metal ratio of preferably 3 or less, more preferably 1.5 or less and particularly preferably 1.2 or less is added as an essential component since it is more excellent in an oxidation stability, a base number maintaining property, a high temperature cleaning property and the like. The metal ratio referred to herein is represented by (valency of metal element in metal base detergent)×(content of metal element (mol %))/(content of soap group (mol %)), wherein the metal element means calcium, magnesium and the like, and the soap group means a sulfonic acid group, a phenol group, a salicylic acid group and the like.

In the present invention, a content of the metal base detergent is usually 1% by mass or less, preferably 0.5% by mass or less in terms of an amount of a metal element, and it is more preferably 0.25% by mass or less in order to reduce a sulfated ash content of the composition. Also, a content of the metal base detergent is 0.005% by mass or more, preferably 0.01% by mass or more in terms of an amount of a metal element, and it is more preferably 0.05% by mass or more in order to enhance more the oxidation stability, the base number maintaining property and the high temperature cleaning property. In particular, controlling the content to 0.08% by mass or more makes it possible to obtain the composition in which a base number and a high temperature cleaning property can be maintained over a long period of time, and therefore it is particularly preferred. The sulfated ash content referred to herein shows a value measured according to a method prescribed in 5. "Sulfated ash content test method" of JIS K 2272, and it originates principally in metal-containing additives.

The antioxidant includes phenol base antioxidants, amine base antioxidants, molybdenum amine complex base antioxidants, and the like. The phenol base antioxidants include, for example, 4,4'-methylenebis(2,6-di-t-butylphenol); 4,4'-bis(2,6-di-t-butylphenol); 4,4'-bis(2-methyl-6-t-butylphenol); 2,2'-methylenebis(4-ethyl-6-t-butylphenol); 2,2'-methylenebis(4-methyl-6-t-butylphenol); 4,4'-butylidenebis(3-methyl-6-t-butylphenol); 4,4'-isopropylidenebis(2,6-di-t-butylphenol); 2,2'-methylenebis(4-methyl-6-nonylphenol); 2,2'-isobutylidenebis(4,6-dimethylphenol); 2,2'-methylenebis(4-methyl-6-cyclohexylphenol); 2,6-di-t-butyl-4-methylphenol; 2,6-di-t-butyl-4-ethylphenol; 2,4-dimethyl-6-t-butylphenol; 2,6-di-t-amyl-p-cresol; 2,6-di-t-butyl-4-(N,N'-dimethylaminomethylphenol; 4,4'-thiobis(2-methyl-6-t-butylphenol); 4,4'-thiobis(3-methyl-6-t-butylphenol); 2,2'-thiobis(4-methyl-6-t-butylphenol); bis(3-methyl-4-hydroxy-5-t-butylbenzyl) sulfide; bis(3,5-di-t-butyl-4-hydroxybenzyl) sulfide; n-octyl-3-(4-hydroxy-3,5-di-t-butylphenyl) propionate; n-octadecyl-3-(4-hydroxy-3,5-di-t-butylphenyl) propionate; 2,2'-thio[diethyl-bis-3-(3,5-di-t-butyl-4-hydroxyphenyl) propionate] and the like. Among them, the bisphenol base antioxidants and the ester group-containing phenol base antioxidants are particularly preferred.

The amine base antioxidants include, for example, monoalkyldiphenylamines such as monooctyldiphenylamine, monononyldiphenylamine and the like; dialkyldiphenylamines such as 4,4'-dibutyldiphenylamine, 4,4'-dipentyldiphenylamine, 4,4'-dihexldiphenylamine, 4,4'-diheptyldiphenylamine, 4,4'-diocyldiphenylamine, 4,4'-dinonyldiphenylamine and the like; polyalkyldiphenylamines such as tetrabutyldiphenylamine, tetrahexyldiphenylamine, tetraocyldiphenylamine, tetranonyldiphenylamine and the like; naphthyl amine base antioxidants, to be specific, α-naphthylamine, phenyl-α-naphthylamine and alkyl-substituted phenyl-α-naphthylamines such as butylphenyl-α-naphthylamine, pentylphenyl-α-naphthylamine, hexylphenyl-α-naphthylamine, heptylphenyl-α-naphthylamine, octylphenyl-α-naphthylamine, nonylphenyl-α-naphthylamine and the like. Among them, the dialkyldiphenylamine base antioxidants and the naphthylamine base antioxidants are suited.

Compounds obtained by reacting hexavalent molybdenum compounds, to be specific, molybdenum trioxide and/or molybdic acid with amine compounds, for example, compounds obtained by a production process described in Japanese Patent Application Laid-Open No. 252887/2003 can be used as the molybdenum amine complex base antioxidant.

The amine compounds reacted with the hexavalent molybdenum compounds shall not specifically be restricted and include, to be specific, monoamines, diamines, polyamines and alkanolamines. To be more specific, capable of being shown as the examples thereof are alkylamines having an alkyl group having 1 to 30 carbon atoms (the alkyl group may be linear or branched) such as methylamine, ethylamine, dimethylamine, diethylamine, methylethylamine, methylpropylamine and the like; alkenylamines having an alkenyl group having 2 to 30 carbon atoms (the alkenyl group may be linear or branched) such as ethenylamine, propenylamine, butenylamine, octenylamine, oleylamine and the like; alkanolamines having an alkanol group having 1 to 30 carbon atoms (the alkanol group may be linear or branched) such as methanolamine, ethanolamine, methanolethanolamine, methanolpropanolamine and the like; alkylenediamines having an alkylene group having 1 to 30 carbon atoms such as methylenediamine, ethylenediamine, propylenediamine, butylenediamine and the like; polyamines such as diethylenetriamine, triethylenetetramine, tetraethylenepentamine, pentaethylenehexamine and the like; amines prepared by reacting the monoamines, the diamines and the polyamines each described above with compounds having an alkyl group or an alkenyl group having 8 to 20 carbon atoms and heterocyclic compounds such as imidazoline and the like, such as undecyldiethylamine, undecyldiethanolamine, dodecyldipropanolamine, oleyldiethanolamine, oleylpropylenediamine, stearyltetraethylenepentamine and the like; alkylene oxide adducts of the above compounds; and mixtures thereof and the like. Further, sulfur-containing molybdenum complexes of succinimide described in Japanese Patent Publication No. 22438/H3 and Japanese Patent Application Laid-Open No. 2866/2004 can be shown as the examples thereof.

The wear resistant agent and the extreme pressure agent include sulfur-containing compounds such as zinc dithiocarbamate, zinc phosphate, disulfides, sulfurized olefins, sulfurized oils & fats, sulfurized esters, thiocarbonates, thiocarbamates and the like; phosphorous-containing compounds such as phosphite esters, phosphate esters, phosphonate esters, amine salts or metal salts thereof and the like; sulfur and phosphorus-containing wear resistant agents such as thiophosphite esters, thiophosphate esters, thiophosphonate esters, amine salts or metal salts thereof and the like.

Optional compounds usually used as friction controlling agents for lubricating oils can be used as the other friction controlling agent and include, for example, ashless friction controlling agents such as fatty acids, aliphatic alcohols and aliphatic ethers each having at least one alkyl group or alkenyl group having 6 to 30 carbon atoms in a molecule.

The rust preventive includes petroleum sulfonates, alkylbenzenesulfonates, dinonylnaphthalenesulfonates, alkenylsuccinic esters, polyhydric alcohol esters and the like. A blending amount of the above rust preventives is usually 0.01 to 1% by mass, preferably 0.05 to 0.5% by mass based on a whole amount of the lubricating oil composition from the viewpoint of the blending effect.

The surfactant or the emulsification resistant agent includes polyalkylene glycol base nonionic surfactants such as polyoxyethylene alkyl ethers, polyoxyethylene alkylphenyl ethers, polyoxyethylene alkylnaphthyl ethers and the like.

The defoaming agent includes silicone oils, fluorosilicone oils, fluoroalkyl ethers and the like, and it is added preferably in an amount of 0.005 to 0.1% by mass based on a whole amount of the composition from the viewpoint of balance between a defoaming effect and an economical efficiency.

In the lubricating oil composition of the present invention, a sulfur content is preferably 0.3% by mass or less. If the sulfur content is 0.3% by mass or less, a catalyst for clarifying an exhaust gas can be inhibited from being reduced in a performance, and the more preferred sulfur content is 0.2% by mass or less.

The phosphorus content is preferably 0.1% by mass or less. If the phosphorus content is 0.1% by mass or less, a catalyst for clarifying an exhaust gas can be inhibited from being reduced in a performance.

The sulfated ash content is preferably 0.6% by mass or less. If the sulfated ash content is 0.6% by mass or less, a catalyst for clarifying an exhaust gas can be inhibited, as described above, from being reduced in a performance. In diesel engines, a filter of DPF (diesel particulate filter) is decreased in an ash amount deposited thereon and inhibited from being clogged by the ash, and DPF is elongated in a lifetime. The sulfated ash content referred to herein shows a value measured by a method prescribed in 5. "Sulfated ash content test method" of JIS K 2272, and it originates principally in metal-containing additives.

The lubricating oil composition of the present invention is a lubricating oil composition used for internal combustion engines such as gasoline engines, diesel engines, gas engines and the like, and it has a high corrosion preventing property to copper and lead as well as an excellent friction reducing effect. Further, it is a lubricating oil composition of an environmental regulation compliant type which is reduced in a phosphorus content and a sulfated ash content.

EXAMPLES

Next, the present invention shall be explained in further details with reference to examples, but the present invention shall by no means be restricted by these examples.

Lubricating oil compositions having compositions and blending amounts shown in Table 1 were prepared to carry out a metal corrosion test. The test results and the properties of the lubricating oil compositions are shown in Table 2. The respective components used for preparing the lubricating oil compositions are shown below.

(1) Base oil A: hydrorefined base oil, kinematic viscosity at 40° C.: 21 $mm^2/s$, kinematic viscosity at 100° C.: 4.5 $mm^2/S$, viscosity index: 127, % $C_A$: 0.1 or less, sulfur content: less than 20 ppm by mass, NOACK vaporization amount: 13.3% by mass (2) Base oil B: poly-α-olefin, kinematic viscosity at 40° C.: 17.5 $mm^2/s$, kinematic viscosity at 100° C.: 3.9 $mm^2/s$, viscosity index: 120, NOACK vaporization amount: 14.9% by mass (3) Base oil C: poly-α-olefin, kinematic viscosity at 40° C.: 28.8 $mm^2/s$, kinematic viscosity at 100° C.: 5.6 $mm^2/s$, viscosity index: 136, NOACK vaporization amount: 6.0% by mass (4) Molybdenum dithiocarbamate: SAKURA-LUBE 515 (manufactured by ADEKA Corporation), Mo content: 10.0% by mass, sulfur content: 11.5% by mass (5) Amide base friction controlling agent: oleic acid diethanolamide (6) Ester base friction controlling agent: glycerol monooleate (7) Amine base friction controlling agent: KIKU-LUBE FM910 (manufactured by ADEKA Corporation)

(8) Zinc dithiophosphate: zinc content: 9.0% by mass, phosphorus content: 8.2% by mass, sulfur content: 17.1% by mass, alkyl group: mixture of secondary butyl and secondary hexyl (9) Metal inactivating agent: 1-[N,N-bis(2-ethylhexyl)aminomethyl]methylbenzotriazole

(10) Viscosity index improving agent A: polymethacrylate, weight average molecular weight: 420,000, resin amount: 39% by mass

(11) Viscosity index improving agent B: styrene-isobutylene copolymer, weight average molecular weight: 583,500, resin amount: 10% by mass

(12) Phenol base antioxidant: octadecyl-3-(3,5-di-tert-buty-4-hydroxylphenyl) propionate

(13) Amine base antioxidant: dialkyldiphenylamine, nitrogen content: 4.62% by mass

(14) Molybdenum amine base antioxidant: SAKURA-LUBE S-710 (manufactured by ADEKA Corporation), molybdenum content: 10% by mass

(15) Metal base detergent (A): perbasic calcium phenate, base number (perchloric acid method): 255 mg KOH/g, calcium content: 9.3% by mass, sulfur content: 3.0% by mass

(16) Metal base detergent (B): perbasic calcium salycilate, base number (perchloric acid method): 225 mg KOH/g, calcium content: 7.8% by mass, sulfur content: 0.3% by mass

(17) Metal base detergent (C): calcium sulfonate, base number (perchloric acid method): 17 mg KOH/g, calcium content: 2.4% by mass, sulfur content: 2.8% by mass

(18) Ashless dispersant A: polybutenylsuccinmonoimide (number average molecular weight of polybutenyl group: 1000, nitrogen content: 1.76% by mass, boron content: 2.0% by mass)

(19) Ashless dispersant B: polybutenylsuccinmonoimide (number average molecular weight of polybutenyl group: 1000, nitrogen content: 1.23% by mass, boron content: 1.3% by mass)

(20) Ashless dispersant C: polybutenylsuccinbisimide (number average molecular weight of polybutenyl group: 2000, nitrogen content: 0.99% by mass)

(21) Other additives: a rust preventive, an emulsification resistant agent and a defoaming agent.

The properties of the base oils and the lubricating oils were measured according to the following tests.

Properties of the Base Oils:

Kinematic viscosity: measured according to JIS K 2283.

Viscosity index: measured according to JIS K 2283.

% $C_A$: calculated by a ring analysis n-d-M method.

NOACK vaporization amount: the vaporization amount was measured on the conditions of 250° C. and one hour according to JPI-5S-41-2004.

Properties of the Lubricating Oil Compositions:

Phosphorus content: measured according to JPI-5S-38-92.

Sulfated ash content: measured according to JIS K2272.

Corrosion Test:

A glass-made test tube was charged with 100 ml of the test oil, and a copper plate (75 mm×12.5 mm×2.5 mm) and a lead plate (25 mm×25 mm×1.0 mm) which were polished were dipped in the test oil to carry out a corrosion test. The test was carried out at an oil temperature of 135° C. for 168 hours while blowing air at a flow amount of 5 L/hour. The results thereof were evaluated by (1) a discoloration degree of the copper plate, (2) an elution amount of copper and (3) an elution amount of lead. In the present test, the oils showing the results that the discoloration of copper was 2 or less in terms of a discoloration number and that the elution amounts of copper and lead were 20 ppm or less and 100 ppm or less respectively were judged to have a good corrosion resistance. The standards of the evaluation are based on the following prescriptions.

Discoloration degree of the copper plate: measured according to a judging method of a copper plate prescribed in JIS K 2513.

Elution amount of copper: measured according to JPI-5S-38-92.

Elution amount of lead: measured according to JPI-5S-38-92.

TABLE 1

| | | Example | | | | | Comparative Example | | | | | |
|---|---|---|---|---|---|---|---|---|---|---|---|---|
| Blend composition (% by mass) | | 1 | 2 | 3 | 4 | 5 | 1 | 2 | 3 | 4 | 5 | 6 |
| (A) | Base oil A | 67.40 | 67.75 | 68.05 | 67.90 | 68.25 | 67.95 | 66.95 | 66.95 | 66.95 | 68.00 | 67.45 |
| | Base oil B | 10.00 | 10.00 | 10.00 | 5.00 | 5.00 | 10.00 | 10.00 | 10.00 | 10.00 | 5.00 | 10.00 |
| | Base oil C | 5.00 | 5.00 | 5.00 | 10.00 | 10.00 | 5.00 | 5.00 | 5.00 | 5.00 | 10.00 | 5.00 |
| (B) | Molybdenum dithiocarbamate | 0.70 | 0.35 | 0.70 | 0.70 | 0.35 | 0.70 | 0.70 | 0.70 | 0.70 | 0.70 | 0.70 |
| (C) | Amide base friction controlling agent | 0.30 | 0.30 | 0.60 | 0.60 | 0.60 | — | 1.00 | — | — | 0.80 | 0.30 |
| (D) | Ester base friction controlling agent | 0.30 | 0.30 | 0.30 | — | 0.30 | — | — | 1.00 | — | — | 0.30 |
| | Amine base friction controlling agent | — | — | — | 0.30 | — | — | — | — | 1.00 | — | — |
| (E) | Metal inactivating agent | 0.05 | 0.05 | 0.05 | 0.05 | 0.05 | 0.05 | 0.05 | 0.05 | 0.05 | 0.05 | — |
| (F) | Zinc dialkyldithiophosphate | 0.90 | 0.90 | 0.90 | 0.55 | 0.55 | 0.90 | 0.90 | 0.90 | 0.90 | 0.55 | 0.90 |
| Others | Viscosity index improving agent A | 6.50 | 6.50 | 6.50 | — | — | 6.50 | 6.50 | 6.50 | 6.50 | — | 6.50 |
| | Viscosity index improving agent B | — | — | — | 6.00 | 6.00 | — | — | — | — | 6.00 | — |
| | Phenol base antioxidant | 0.20 | 0.20 | 0.20 | 0.20 | 0.20 | 0.20 | 0.20 | 0.20 | 0.20 | 0.20 | 0.20 |
| | Amine base antioxidant | 0.30 | 0.30 | 0.30 | 0.30 | 0.30 | 0.30 | 0.30 | 0.30 | 0.30 | 0.30 | 0.30 |
| | Molybdenum amine base antioxidant | 0.10 | 0.10 | 0.10 | 0.10 | 0.10 | 0.10 | 0.10 | 0.10 | 0.10 | 0.10 | 0.10 |
| | Metal base detergent A | 0.95 | 0.95 | — | — | — | 1.00 | 1.00 | 1.00 | 1.00 | — | 0.95 |
| | Metal base detergent B | — | — | — | 1.10 | 1.10 | — | — | — | — | 1.10 | — |
| | Metal base detergent C | 0.80 | 0.80 | 0.80 | 0.70 | 0.70 | 0.80 | 0.80 | 0.80 | 0.80 | 0.70 | 0.80 |
| | Ashless dispersant A | — | — | — | 1.00 | 1.00 | — | — | — | — | 1.00 | — |
| | Ashless dispersant B | 2.00 | 2.00 | 2.00 | — | — | 2.00 | 2.00 | 2.00 | 2.00 | — | 2.00 |
| | Ashless dispersant C | 4.00 | 4.00 | 4.00 | 5.00 | 5.00 | 4.00 | 4.00 | 4.00 | 4.00 | 5.00 | 4.00 |
| | Other additives | 0.50 | 0.50 | 0.50 | 0.50 | 0.50 | 0.50 | 0.50 | 0.50 | 0.50 | 0.50 | 0.50 |
| Total | | 100.00 | 100.00 | 100.00 | 100.00 | 100.00 | 100.00 | 100.00 | 100.00 | 100.00 | 100.00 | 100.00 |

TABLE 2

| | | Example | | | | | Comparative Example | | | | | |
|---|---|---|---|---|---|---|---|---|---|---|---|---|
| | | 1 | 2 | 3 | 4 | 5 | 1 | 2 | 3 | 4 | 5 | 6 |
| Property | MoDTC content, molybdenum (% by mass) | 0.070 | 0.035 | 0.070 | 0.070 | 0.035 | 0.070 | 0.070 | 0.070 | 0.070 | 0.070 | 0.070 |
| | Phosphorus content (% by mass) | 0.074 | 0.074 | 0.074 | 0.045 | 0.045 | 0.074 | 0.074 | 0.074 | 0.074 | 0.045 | 0.074 |
| | Sulfated ash content (% by mass) | 0.59 | 0.57 | 0.59 | 0.50 | 0.48 | 0.59 | 0.59 | 0.59 | 0.59 | 0.50 | 0.59 |
| Corrosion test | Discoloration of copper plate | 2e | 2d | 2d | 2e | 2c | 4e | 2a | 4a | 4a | 2a | 3b |
| | Elution amount of copper (ppm) | 17 | 20 | 15 | 16 | 16 | 39 | 16 | 17 | 31 | 17 | 42 |
| | Elution amount of lead (ppm) | 18 | 59 | 65 | 85 | 58 | 10 or less | 396 | 43 | 24 | 287 | 38 |

The numerical values of "MoDTC content, molybdenum" in Table 2 show a content of molybdenum originating in MoDTC based on a whole amount of the lubricating oil composition.

A corrosion property to copper and lead is inhibited in the lubricating oil compositions prepared in Examples 1 to 5. On the other hand, the lubricating oil composition prepared in Comparative Example 1 does not contain the amide base friction controlling agent, the ester base friction controlling agent and the amine base friction controlling agent, and corrosion to copper brought about by MoDTC results in being markedly shown. On the other hand, in Comparative Example 2 or 5 in which only the amide base friction controlling agent among the friction controlling agents described above was blended, corrosion to copper is improved as compared with Comparative Example 1, but corrosion to lead is elevated more. Further, in Comparative Examples 3 and 4 in which only the ester base friction controlling agent or the amine base friction controlling agent was blended, corrosion to copper is not observed to be improved. The lubricating oil composition prepared in Comparative Example 6 contains the amide base friction controlling agent and the ester base friction controlling agent but does not contain the copper inactivating agent, and it is deteriorated in corrosion to copper.

INDUSTRIAL APPLICABILITY

The lubricating oil composition of the present invention has a high corrosion preventing property to copper and lead as well as an excellent friction reducing effect. Further, it is a lubricating oil composition of an environmental regulation compliant type which is reduced in a phosphorus content and a sulfated ash content, and it is used for internal combustion engines such as gasoline engines, diesel engines, gas engines and the like.

What is claimed is:

1. A lubricating oil composition, comprising, by mass, based on a whole amount of the composition:

(A) a base oil for a lubricating oil;

(B) 0.03 to 0.08%, in terms of molybdenum, of a sulfated oxymolybdenum dithiocarbamate of formula (I):

(I)

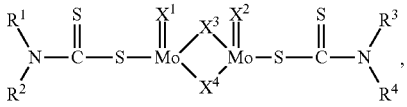

wherein $R^1$ to $R^4$ are each independently a hydrocarbyl group comprising 4 to 22 carbon atoms, and $X^1$ to $X^4$ are each a sulfur atom or an oxygen atom;

(C) 0.3 to 0.6% of an acid amide compound obtained by reacting a mono- to tetravalent carboxylic acid with an alkylamine or alkanolamine;

(D) 0.3 to 0.6% of at least one of (d1) a partial ester compound obtained by reacting a fatty acid with an aliphatic polyhydric alcohol and (d2) an aliphatic amine compound; and (E) 0.03 to 0.05% of a benzotriazole of formula (II):

(II)

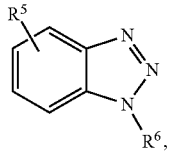

wherein $R^5$ and $R^6$ each are independently a hydrocarbyl group comprising 1 to 30 carbon atoms which optionally comprises an oxygen atom, a sulfur atom, or a nitrogen atom, and wherein the lubricating oil composition is suitable for an internal combustion engine.

2. The composition of claim 1, further comprising:

(F) a zinc dithiophosphate of formula (III):

(III)

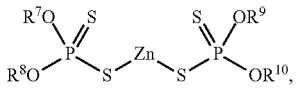

wherein each of $R^7$, $R^8$, $R^9$, and $R^{10}$ are independently a substituent selected from the group consisting of a primary alkyl group comprising 3 to 22 carbon atoms, a secondary alkyl group comprising 3 to 22 carbon atoms, and an alkylaryl group substituted with an alkyl group comprising 3 to 18 carbon atoms.

3. The composition of claim 1, wherein a phosphorus content is 0.1% by mass or less based on the composition, and a sulfated ash content is 0.6% by mass or less.

4. The composition of claim 2, wherein a phosphorus content is 0.1% by mass or less based on the composition, and a sulfated ash content is 0.6% by mass or less.

5. The composition of claim 1, wherein the alkanolamine of (C) comprises a hydroxyalkyl group comprising 2 to 6 carbon atoms with a monovalent fatty acid comprising a linear or branched hydrocarbon group comprising 6 to 30 carbon atoms.

6. The composition of claim 5, wherein, in the monovalent fatty acid of the acid amide compound (C), the hydrocarbon group is at least one selected from the group consisting of hexyl, heptyl, octyl, nonyl, decyl, undecyl, dodecyl, tridecyl, tetradecyl, pentadecyl, hexadecyl, heptadecyl, octadecyl, nonadecyl, icosyl, pentaicosyl, docosyl, tricosyl, tetracosyl, pentacosyl, hexacosyl, heptacosyl, octacosyl, nonacosyl, and triacontyl.

7. The composition of claim 5, wherein, in the monovalent fatty acid of the acid amide compound (C), the hydrocarbon group is at least one selected from the group consisting of hexenyl, heptenyl, octenyl, nonenyl, decenyl, undecenyl, dodecenyl, tridecenyl, tetradecenyl, pentadecenyl, hexadecenyl, heptadecenyl, octadecenyl, nonadecenyl, icosenyl, henicosenyl, docosenyl, tricosenyl, tetracosenyl, pentacosenyl, hexacosenyl, heptacosenyl, octacosenyl, nonacosenyl, triacontenyl, and a hydrocarbon group comprising at least two double bonds.

8. The composition of claim 1, wherein, in the acid amide compound (C), the carboxylic acid is at least one selected from the group consisting of oxalic acid, phthalic acid, trimellitic acid, and pyromellitic acid.

9. The composition of claim 5, wherein, in the acid amide compound (C), the alkanolamine is at least one selected from the group consisting of monoethanolamine, diethanolamine, triethanolamine, N-methylethanolamine, N,N-dimethylethanolamine, N-ethylethanolamine, N,N-diethylethanolamine, N-isopropylethanolamine, N,N-diisopropylethanolamine, monoisopropanolamine, diisopropanolamine, triisopropanolamine, N-methylisopropanolamine, N,N-dimethylisopropanolamine, N-ethylisopropanolamine, N,N-diethylisopropanolamine, N-isopropylisopropanolamine, N,N-diisopropylisopropanolamine, mono-n-propanolamine, di-n-propanolamine, tri-n-propanolamine, N-methyl-n-propanolamine, N,N-dimethyl-n-propanolamine, N-ethyl-n-propanolamine, N,N-diethyl-n-propanolamine, N-isopropyl-n-propanolamine, N,N-diisopropyl-n-propanolamine, monobutanolamine, dibutanolamine, tributanolamine, N-methylbutanolamine, N,N-dimethylbutanolamine, N-ethylbutanolamine, N,N-diethylbutanolamine, N-isopropylbutanolamine, and N,N-diisopropylbutanolamine.

10. The composition of claim 5, wherein, in the acid amide compound (C), the monovalent fatty acid is at least one selected from the group consisting of caproic acid, caprylic acid, capric acid, lauric acid, myristic acid, palmitic acid, stearic acid, arachidic acid, behenic acid, lignoceric acid, myristoleic acid, palmitoleic acid, oleic acid, and linilenic acid.

11. The composition of claim 1, wherein the acid amide compound (C) is at least one selected from the group consisting of oleic acid monoethanolamide, oleic acid diethanolamide, oleic acid monopropanolamide, and oleic acid dipropanolamide.

12. The composition of claim 1, wherein the acid amide compound (C) is oleic acid diethanolamide.

13. The composition of claim 1, wherein, in the acid amide compound (C), the alkylamine or alkanolamine comprises only one amine moiety.

14. The composition of claim 1, wherein, in the sulfated oxymolybdenum dithiocarbamate (B), at least one of $X^1$ to $X^4$ is a sulfur atom while at least one of $X^1$ to $X^4$ is an oxygen atom.

15. The composition of claim 14, wherein, in $X^1$ to $X^4$ of the sulfated oxymolybdenum dithiocarbamate (B), a ratio of sulfur atoms to oxygen atoms is 1/3 to 3/1.

16. The composition of claim 14, wherein, in $X^1$ to $X^4$ of the sulfated oxymolybdenum dithiocarbamate (B), a ratio of sulfur atoms to oxygen atoms is 1.5/2.5 to 3/1.

17. The composition of claim 1, wherein, in the at least one sulfated oxymolybdenum dithiocarbamate (B), $R^1$ to $R^4$ are independently a branched or linear alkyl group or alkenyl group comprising 4 to 18 carbon atoms.

18. The composition of claim 1, wherein, in the sulfated oxymolybdenum dithiocarbamate (B), $R^1$ to $R^4$ are independent) an alkyl group comprising 8 to 13 carbon atoms.

19. The composition of claim 1, wherein, for (C), the acid amide compound is obtained by reacting a mono- to tetravalent carboxylic acid with an alkanolamine.

20. The composition of claim 1, wherein (D) is the aliphatic amine compound (d2).

21. The composition of claim 1, wherein (D) comprises the fatty acid partial ester compound (d1) and the aliphatic amine compound (d2).

22. The composition of claim 1, wherein the fatty acid partial ester compound (d1) is present.

23. The composition of claim 22, wherein the aliphatic polyhydric alcohol comprises ethylene glycol or trimethylolpropane.

24. The composition of claim 22, wherein the aliphatic polyhydric alcohol comprises glycerin.

* * * * *